United States Patent [19]

Lee

[11] Patent Number: 5,004,375

[45] Date of Patent: Apr. 2, 1991

[54] BASEMENT PILES AND BASEMENT CONSTRUCTION METHOD ASSOCIATED THEREWITH

[76] Inventor: Yuan-Ho Lee, No. 851, Chung-San Rd., Nan-Pao Tsun, Kuei-Jen, Hsian, Tainan Hsieng, Taiwan

[21] Appl. No.: 370,254

[22] Filed: Jun. 22, 1989

[51] Int. Cl.[5] ..... F02D 5/00

[52] U.S. Cl. ..... 405/230; 405/229; 405/232

[58] Field of Search ..... 405/229, 230, 231, 232, 405/250, 251; 52/742

[56] References Cited

U.S. PATENT DOCUMENTS

| | | | |
|---|---|---|---|
| 109,637 | 11/1870 | Lilienthal | 405/251 X |
| 415,037 | 11/1889 | Gray | 405/251 |
| 2,741,910 | 4/1956 | Thornley | 405/229 X |
| 3,263,431 | 8/1966 | Phares | 405/251 |
| 4,695,203 | 9/1987 | Gregory | 405/230 |
| 4,708,528 | 11/1987 | Rippe | 405/230 |

*Primary Examiner*—Randolph A. Reese
*Assistant Examiner*—John A. Ricci
*Attorney, Agent, or Firm*—Ladas & Parry

[57] ABSTRACT

An improved method of constructing a basement piling is disclosed. The piling of an improved pile, which consists of a plurality of pile units connected with each other, is completed by first driving a pile unit into the construction site of the building, then connecting other pile units to the previously driven pile unit, and further driving the connected pile units into the construction site. The improved method of constructing a basement of a building on a construction site comprises a first step of pre-forming a basement with seat members formed thereon, a second step of providing a plurality of hydraulic devices associated with the seat members, a third step of providing a plurality of piles onto the hydraulic devices and a fourth step of manipulating the plurality of hydraulic devices to allow descent of the pre-formed basement into the construction site.

4 Claims, 4 Drawing Sheets

BASEMENT PILES AND BASEMENT CONSTRUCTION METHOD ASSOCIATED THEREWITH

BACKGROUND OF THE INVENTION

The present invention relates to an improved basement piles and basement construction method associated therewith.

The construction of the basement of a building can be completed by various methods. The conventional method of forming the basement of a building is the so-called "continuous wall method," which consists of the steps of forming a continuous wall at the construction site, excavating the earth work from the site, and starting the formation of the basement. It is known that this procedure is very complex and labor-consuming.

An improved method of constructing a basement was developed in Japan and referred to as the TAKENAKA method. This method consists of the steps of constructing the basement on the construction site, excavating the earthwork beneath the basement construction and sinking and firmly installing the pre-formed basement gradually in the construction site. This TAKENAKA method has enjoyed great popularity, and so has been widely used, in the architecture industry. Therefore, the detailed procedures thereof will not be discussed herewith. Although the TAKENAKA method is very good, said method suffers from two significant problems. The quality and nature of the earthwork are different from construction site to construction site. Once the pre-formed basement is inclined during the procedure of sinking the same into the construction site, it often is very difficult, even impossible, to correct the inclination of said basement. In order to ensure that the basement is sank smoothly and evenly into the construction site, complicated supporting mechanisms are required which affect the overall effectiveness of the method.

SUMMARY OF THE INVENTION

It is therefore the main object of the present invention to provide an improved method of constructing a basement in which the improved driven piles associated therewith are capable of supporting the whole pre-formed basement and enabling a smooth sinking of the same.

It is an important feature and another object of the present invention to gradually drive the improved piles from stage to stage of the basement construction process, the pre-formed basement in turn sinking gradually into the construction site. The improved piles support the weight of the whole pre-formed basement throughout the entire basement construction procedure.

Another feature and object of the present invention is to use a plurality of hydraulic devices, each of said devices being operated to drive an individual pile into the construction site, with the weight of the entire pre-formed basement as a back up for the pile-driving operation.

Still another feature of the present invention lies in the fact that the step of constructing the basement piles is accomplished before the pre-formation of the basement so that the resulting basement construction can be properly supported.

A further object of the present invention is to provide improved basement piles which can be used in the improved construction method of the invention and can be drawn out of the construction site for a re-use.

Accordingly, the method of piling for the construction of a basement comprises the steps of providing a plurality of hydraulic devices on cruciform girders individually driving each pile with said hydraulic apparatus, sinking the pre-formed basement into the construction site by manipulating all of the hydraulic devices, and withdrawing out the piles for reuse.

The improved pile of the invention, to be used in combination with an improved construction method of a basement, comprises a plurality of steel, conical pile units, a pile tip element and means for joining said pile units and said pile tip element.

BRIEF DESCRIPTION OF THE DRAWINGS

These and other advantages, features and objects of the present invention will become apparent from the following detailed description of the preferred embodiment with reference to the accompanying drawings.

DETAILED DESCRIPTION OF THE PREFERRED EMBODIMENTS

Figure 1:
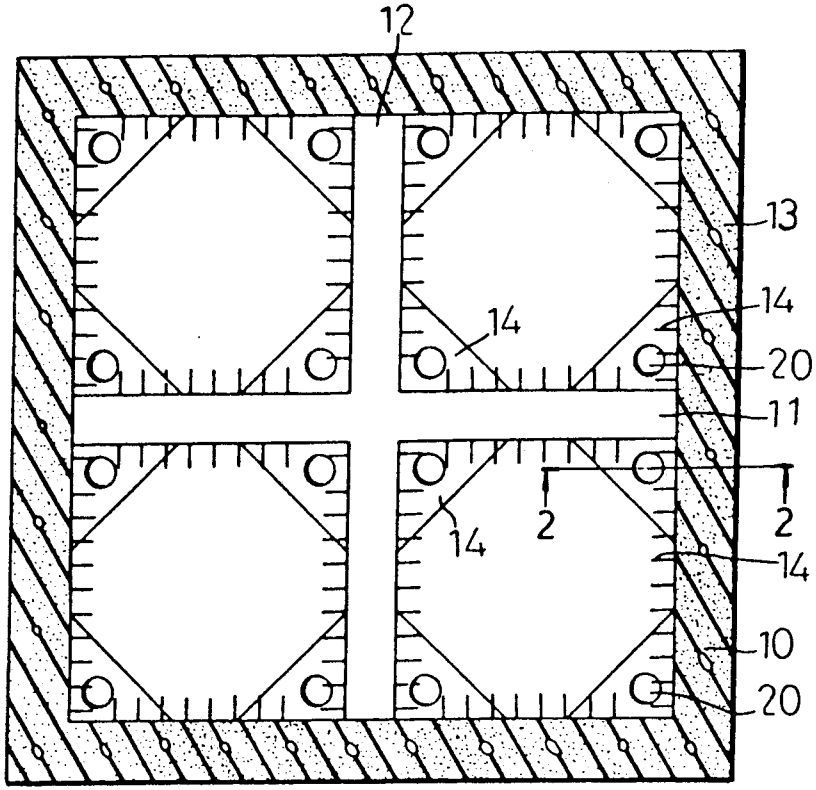
FIG. 1 is a simplified sectional view of a pre-formed basement showing the installation of a plurality of hydraulic devices.

Referring to FIG. 1, the pre-formed basement 10 is substantially a rectangular construction with several stories. Each story of the basement has a cruciform girder 11, 12 and a surrounding concrete wall 13. At intersections of the girders 11, 12 and the surrounding concrete side wall 13, a plurality of seat members 14 are formed which can be formed simultaneously with the grouting procedure of said girders 11, 12 and the concrete side wall 13. A hydraulic device 20 is provided at each seat member 14 of the lowest story of the basement 10.

Figure 2:
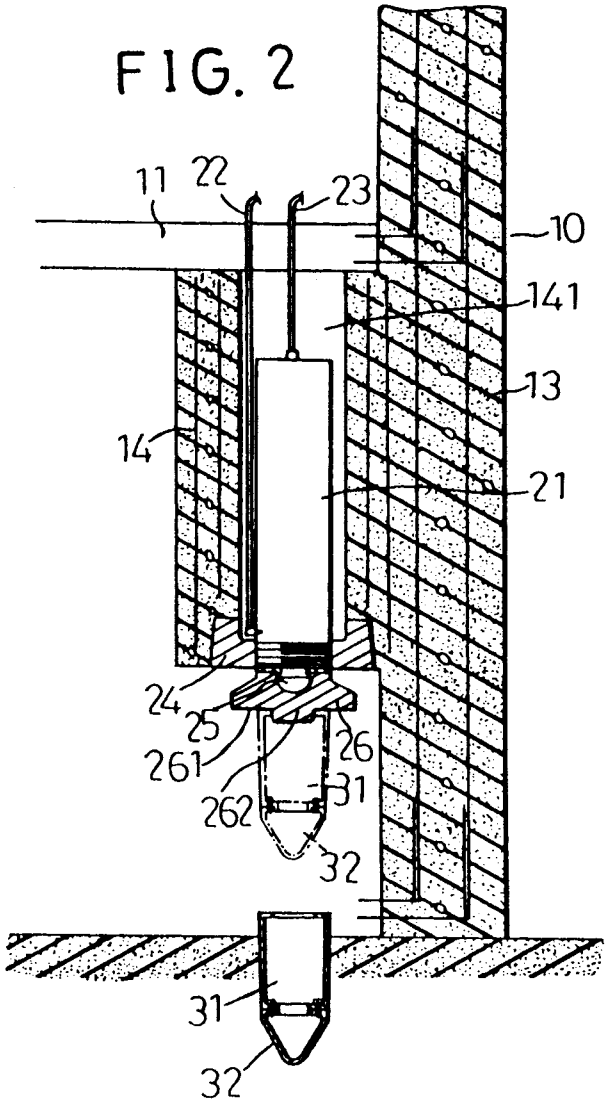
FIG. 2 is a sectional view taken along the line A—A in FIG. 1 for a better illustration of the hydraulic devices at an initial stage of the piling.

Referring to FIG. 2, an accommodation chamber 141 is formed in each of the seat member 14, for the installation of an oil cylinder 21 which acts as a hydraulic device 20. There are inlet and outlet oil pipes 22, 23 connected on the oil cylinder 21 for the conduction of hydraulic oil to an oil pump located at a suitable place. An annular flange 24 is formed at the lower portion of the cylinder 21 for the connection of the same to the seat member 14 with proper fixing means, such as wall expansion screws. A member 26 is provided at the end of the piston rod 25 for the attachment of a pile to be driven by the oil cylinder 21.

Figure 3:
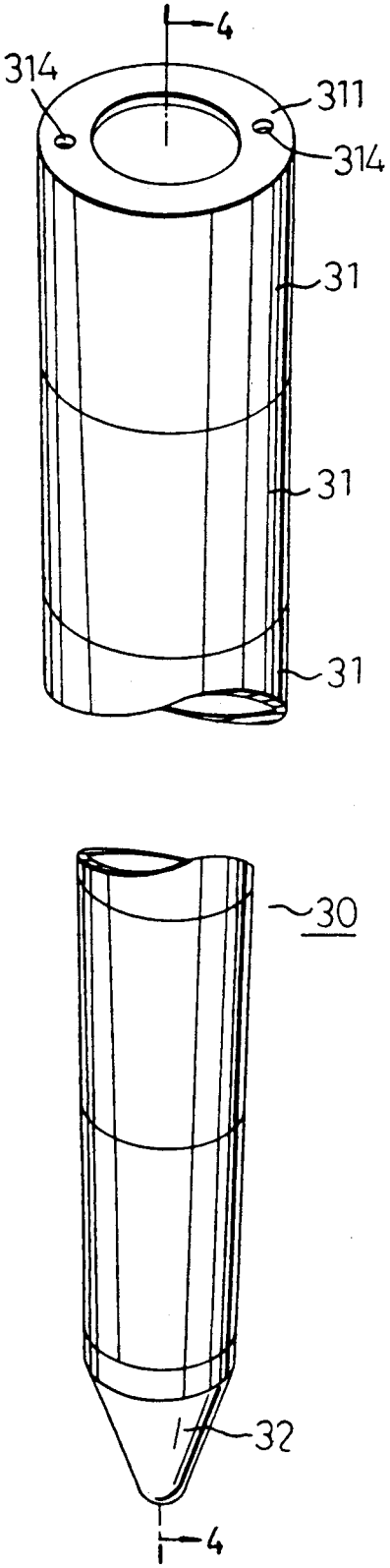
FIG. 3 is a perspective view of the improved pile of the present invention with portions thereof being omitted for the purpose of simplicity.
Figure 4:
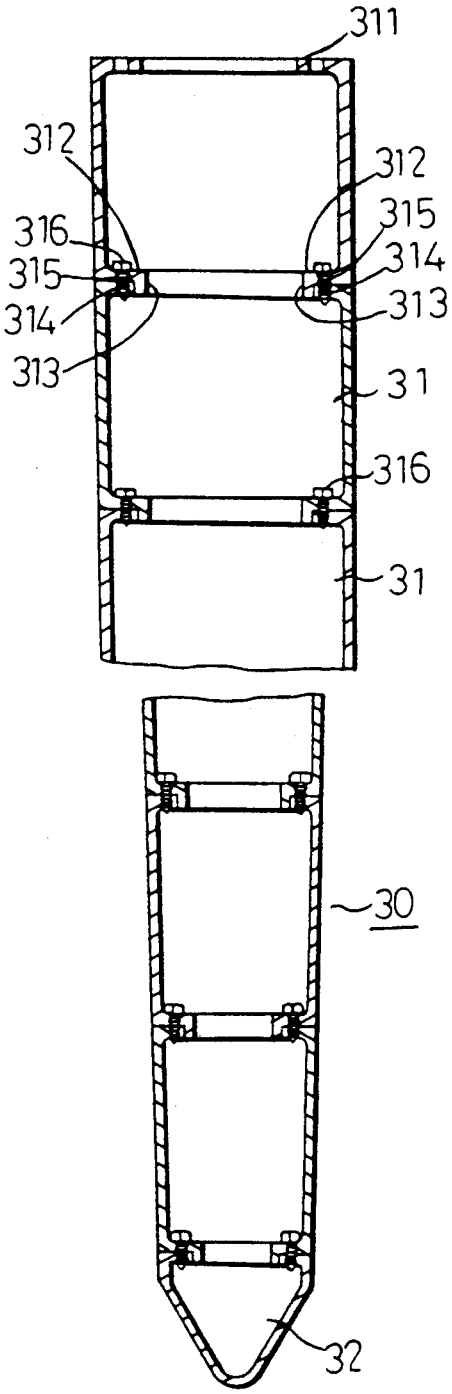
FIG. 4 is a vertical sectional view of the improved pile of this invention taken along line B—B in FIG. 3 to illustrate of the connection of the pile units and the pile tip element.

Referring to both FIGS. 3 and 4, an improved pile 30 of the invention includes a plurality of pile units 31, which together form a conical structure and are made of a steel material, as well as and a pile tip element 32. Each pile unit 31 has a height of about 40 cm. and a diameter of from 20 to 50 cm. The thickness of the steel material forming the pile units is about 15 mm. Each pile unit 31 has upper and lower annular flanges 311, 312 respectively formed at the upper and lower surfaces thereof. Another annular flange 313 in extending a direction parallel to the axis of the pile unit 31 is formed at the lower annual flange 312 and extending outwardly therefrom. The outer diameter of the other flange 313 is almost the same as the inner diameter of the upper flange 311 so that a perfect match can be achieved when two pile units 31 are placed one on top of the other. There are a plurality of openings 314, 315 formed on the flanges 311, 312 in alignment with each other so that two pile units can be connected together by means of a bolt 316 passing through each pair of said openings 314, 315. The opening 314 may also be formed with internal threads on the inner wall thereof so that a screw bolt 316 may be used to directly connect one pile unit 31 to another. It is to be noted that each pile unit 31 is of dimension which will enable one to easily fasten the screw bolt 316 thereon and complete the connection operation. The pile tip element 32 has a structure similar to that of the pile unit 31 except for the fact that the lower end thereof is sealed to form a tip for leading the whole improved pile into the earth.

Referring again to FIG. 2, the member 26 attached on the piston rod 25 of the oil cylinder 21 has a protrusion 262 in the shape of a plateau extending from a lower surface 261 thereof for fitting into the upper portion of a pile unit 31. A hydraulic device 20 used in this embodiment, such as an oil cylinder 21, can be operated to drive a pile 30, which consists of a pile unit 31 and a pile tip element 32, into the earth of the construction site as is shown by the solid line in FIG. 2. The piston rod 25 of the oil cylinder 21 will then be retracted back into said cylinder 21 so as to allow an additional pile unit 31 to be placed thereon and connected to the one already driven into the earth. The piling process will be continued until a strong support for the basement is achieved, i.e. either sufficient friction between the pile and the earth is obtained, or the driving process reaches a point at which a pre-determined hydraulic force from the oil cylinder 21 cannot drive the pile further into the earth.

Figure 5:
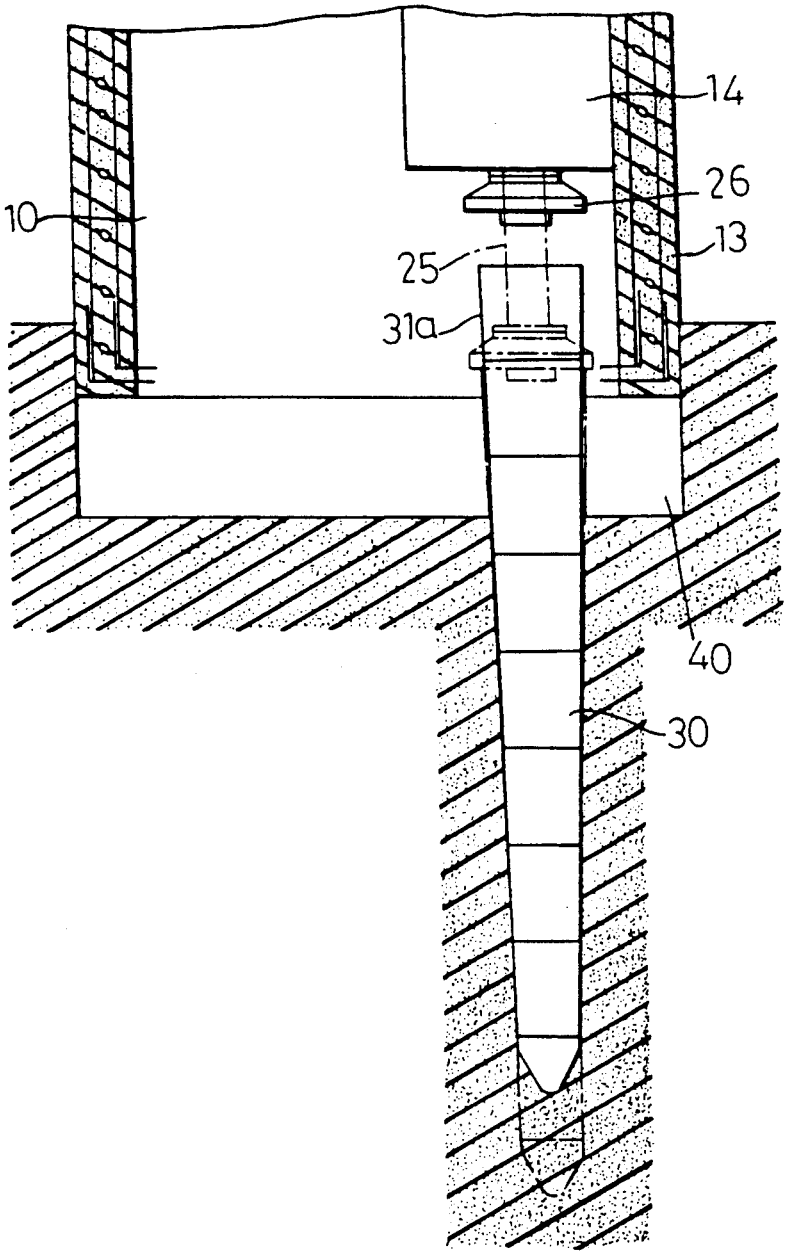
FIG. 5 is a simplified sectional view of the basement in the construction site to illustrate the procedures of piling and the sinking of the basement.
Figure 6:
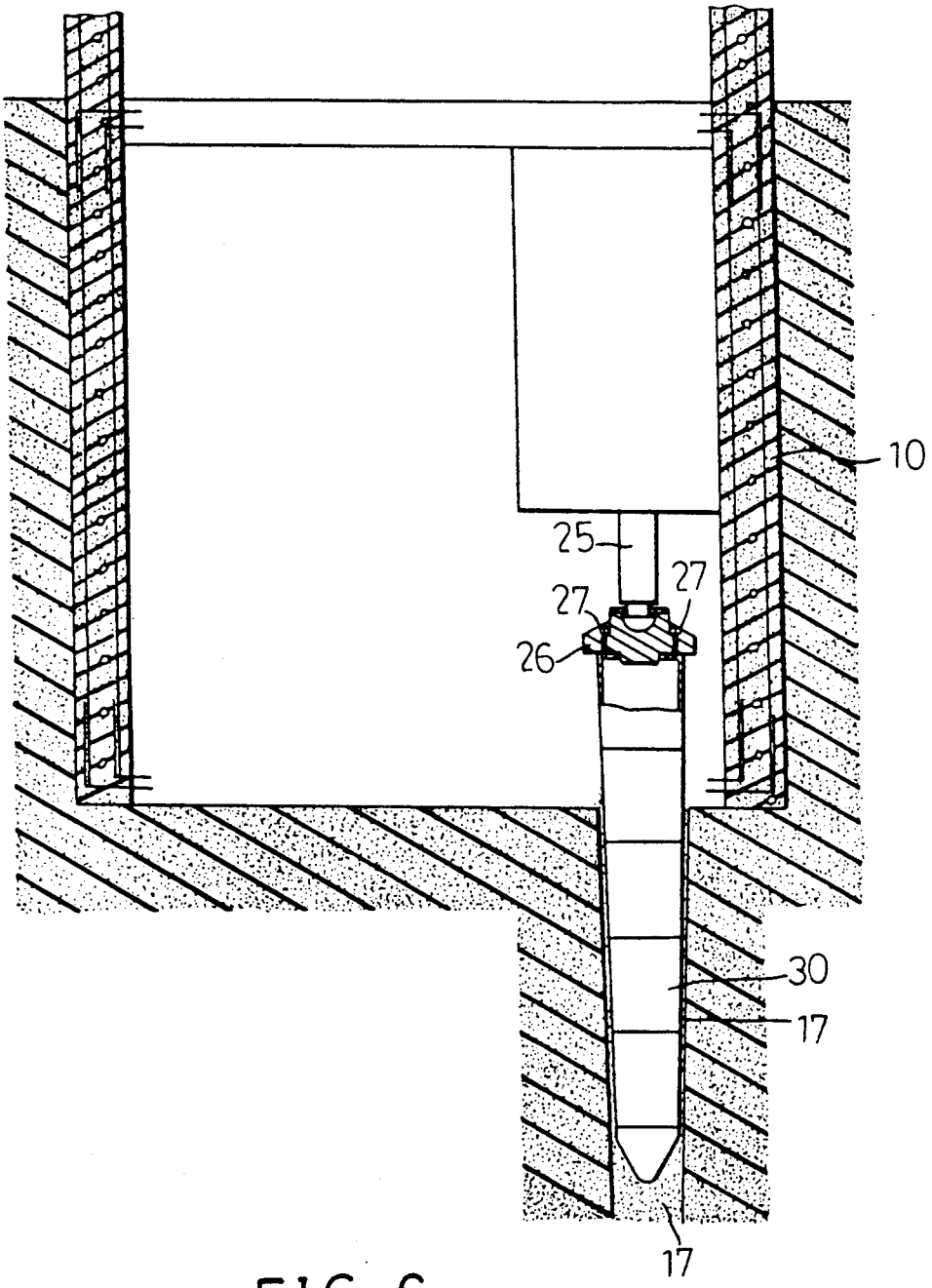
FIG. 6 is a simplified sectional view of the basement at the construction site to illustrate the operation of withdrawing the driven piles.

Referring to FIG. 5, another pile unit is shown in which said pile 31*a* is added to yet another pile 30 which has been driven into the earth under the construction site. The entire pile 30, will be further driven into the earth to the position shown by the dotted lines. In the piling process for basement construction, the piles 30 can be individually driven into the earth so that said driven piles 30 can equally support the weight of the pre-formed basement. At this point, the excavation process can be started so as to move away the earth of the construction site and form a space 40 under the basement 10. Now, all the oil cylinders 21 can be manipulated simultaneously to allow the the piston rods 25 thereof to retract into the cylinder 21 aided by the weight of the basement 10. In another words, the basement 10 will sink into the construction site smoothly and evenly with all of the cylinders 21 supporting the weight thereof. The piling process and the process of manipulating all the cylinders 21 will be reciprocated and continued until the basement has sunk to the desired depth, as shown in FIG. 6. It is to be noted that each time the process of this invention is used, the basement will be controlled to sink to a pre-determined depth so that a smooth sinking of the basement can be obtained. It is also easily understood that each oil cylinder 21 is adjusted to exert a pre-set force onto the pile 30 to be driven. The pile 30 will be easily driven with the weight of the basement reinforcing the action of the back up of the cylinder 21.

With the piling method described hereinabove, the pre-formed basement will sink into the construction site perfectly without inclining in any direction. The improved piles 30 actually accompany the pre-formed basement on its descent to move into the earth. As an alternative, the piles 30 can be driven at a time to a very deep pre-determined position in the construction site. During the sinking of the basement 10, the pile unit 31 will be removed one by one to meet the sinking distance of the basement 10.

Referring to FIG. 6, after the basement 10 has already sunk to a desired position, the pile 30 can be taken out of the earth with the cylinder 21 acting as a pile drawer. The uppermost pile unit 31 is connected to the member 26 of the cylinder 21 by means of a plurality of screws 27. Then, the whole pile 30 can be drawn out from the earth by retracting the piston rod 25 of the cylinder 21 and dissembled by separating the pile units 31 one by one. The cavity 17, which is formed from the process of drawing of the piles 30 from the ground, can be filled with sand or other suitable materials to reform a solid earth work of the construction site. The piles 30 are then ready for re-use.

Another embodiment of the method of piling for the construction of a basement will be described with reference again to FIG. 1. Before pre-forming the basement on the construction site, the piles 30 can be driven into the earth at various pre-determined locations with any suitable apparatus to the depth required. The basement is then constructed on the construction site and a plurality of hydraulic devices are provided on said basement according to the procedures described hereinabove. The process of sinking the basement will then be carried out in the same way as is described hereinabove. The purpose of this alternative embodiment of the piling method is to avoid the possible premature sinking of the pre-formed basement when the earth is too soft.

Although the method of piling and the improved pile are described by way of embodiments, it is still possible for those skilled in the art to make changes and modifications without departing from the spirit of the present invention.

What is claimed is:

1. A method of constructing a basement of a building on a construction site comprising the steps of:

pre-forming the basement construction of a building on a construction site;

providing a plurality of hydraulic devices to be associated with said pre-formed basement;

providing a plurality of piles, each being driven by one of said hydraulic devices into the construction site one by one; and manipulating each of said hydraulic devices simultaneously to sink the pre-formed basement into the construction site.

2. The method as claimed in claim 1 further comprises a fifth step of repeating all of said steps in constructing the basement.

3. The method as claimed in claim 1 wherein said plurality of piles comprise piles the overall length of which can be prolonged so as to be driven to a required depth.

4. A method of constructing a basement of a building on a construction site comprising the steps of:

driving a plurality of piles at pre-determined locations on the construction site;

pre-forming a basement on said construction site with a plurality of seat members formed thereon coinciding with said pre-determined locations;

providing a plurality of hydraulic devices to be associated with said seat members of said pre-formed basement;

further driving each of said piles with said hydraulic device one by one; and manipulating said plurality of hydraulic devices simultaneously to allow the descent of said pre-formed basement into the construction site.

* * * * *